US010106377B1

(12) United States Patent
Johnston

(10) Patent No.: US 10,106,377 B1
(45) Date of Patent: Oct. 23, 2018

(54) LIFTING TOOL

(71) Applicant: Solar Turbines Incorporated, San Diego, CA (US)

(72) Inventor: Ronald Kevin Johnston, El Cajon, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 15/491,169

(22) Filed: Apr. 19, 2017

(51) Int. Cl.
*B66C 1/44* (2006.01)

(52) U.S. Cl.
CPC ..... *B66C 1/44* (2013.01)

(58) Field of Classification Search
CPC ..... B66C 1/48; B66C 1/66; B66C 1/44; B25J 1/04; E02F 3/3405; F16G 15/08
See application file for complete search history.

(56) References Cited

U.S. PATENT DOCUMENTS 1,351,530 A 8/1920 Meals
2,393,101 A 1/1946 Gardner
2,446,610 A * 8/1948 Renfroe ..... B66C 1/48 279/33
3,178,218 A 4/1965 Renfroe
3,507,534 A * 4/1970 Gardner ..... B66C 1/48 188/44
2006/0061112 A1* 3/2006 Schon ..... B66C 1/442 294/101
2010/0109362 A1* 5/2010 Berk ..... B66C 1/442 294/104
2012/0134773 A1* 5/2012 Gillesse ..... B66C 1/48 414/815
2014/0205420 A1* 7/2014 Newth ..... B66C 1/48 414/800

* cited by examiner

*Primary Examiner* — Stephen A Vu
(74) *Attorney, Agent, or Firm* — James R. Smith

(57) ABSTRACT

A lifting tool for gripping an object, is provided. The lifting tool includes a body and a locking arrangement. The body defines a gripping cavity for receiving the object. The locking arrangement lock the object within the gripping cavity. The locking arrangement includes a shaft having an eccentric structure and a pin. The shaft and the eccentric structure are configured to rotate about a longitudinal axis. The pin is configured to engage with the eccentric structure and lock the object within the gripping cavity. The pin is biased in a first position, where a portion of the pin extends into the gripping cavity and locks the object within the gripping cavity.

19 Claims, 6 Drawing Sheets

LIFTING TOOL

TECHNICAL FIELD

The present disclosure relates to a lifting tool for lifting heavy sheet metal and blocks. More particularly, the present disclosure relates to a quick release lifting tool.

BACKGROUND

Lifting heavy objects, such as metal plates and boxes, used in machines such as turbomachine package assemblies, is very difficult and unsafe, primarily, due to the weight of these loads, which go up to thousands of pounds. Various lifting tools are known and intended to be used along with loading or unloading machines, such as cranes and hoisting implements, for lifting such heavy objects. Such objects are generally intended to be positioned inside panels and/or casings which limit access space for an operator operating the lifting and positioning of the object. Therefore, attaching and detaching of such lifting tools also becomes a challenge for the operator.

U.S. Pat. No. 2,393,101 relates to a lifting clamp capable of securely retaining thin-edged elements during a lifting operation. The lifting clamp includes a support member provided with a gripping surface, a pivotally mounted cam secured in spaced relationship with the gripping surface and adapted to co-act with the gripping surface during the lifting operation. The cam is shaped such that upon rotation, the element to be lifted is secured tightly between the cam and the gripping surface.

SUMMARY OF THE INVENTION

According to an aspect of the present disclosure, a lifting tool for gripping an object, is provided. The lifting tool includes a body and a locking arrangement. The body defines a gripping cavity for receiving the object. The locking arrangement lock the object within the gripping cavity. The locking arrangement includes a shaft having an eccentric structure and a pin. The shaft and the eccentric structure are configured to rotate about a longitudinal axis. The pin is configured to engage with the eccentric structure and lock the object within the gripping cavity. The pin is biased in a first position, where a portion of the pin extends into the gripping cavity and locks the object within the gripping cavity.

According another aspect of the present disclosure, a lifting tool for gripping an object, is provided. The lifting tool includes a body and a locking arrangement. The body defines a gripping cavity for receiving the object. The locking arrangement locks the object within the gripping cavity. The locking arrangement includes a shaft having an eccentric structure and a pin. The shaft and the eccentric structure are configured to rotate about a longitudinal axis. The pin is configured to engage with the eccentric structure and lock the object within the gripping cavity. The pin is biased in a first position and configured to move between a second position and a third position. In the first position, a portion of the pin extends into the gripping cavity and is configured to lock the object within the gripping cavity. The locking arrangement further includes an actuating member coupled to the shaft and configured to move the pin. The pin is configured to move towards the second position in response to a movement of the actuating member in a first direction to decrease a retention force on the object. The pin is further configured to move towards the third position in response to the movement of the actuating member in a second direction to increase the retention force on the object.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

Figure 1:
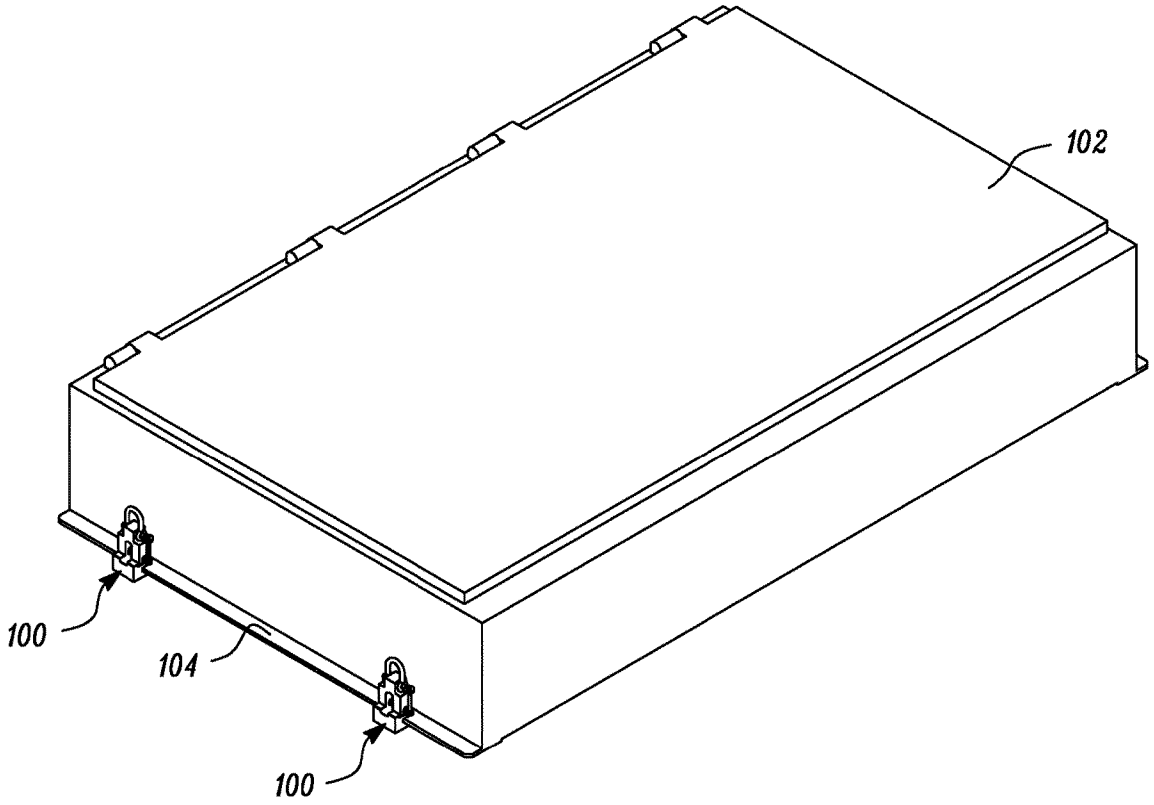
FIG. 1 illustrates one or more lifting tools coupled to an object, in accordance with the concepts of the present disclosure.

The present disclosure relates to a quick release lifting tool for lifting heavy sheet metal and blocks. FIG. 1 illustrates one or more exemplary lifting tools 100 coupled to and configured to lift a heavy object 102. Examples of heavy object 102 may include, but not limited to, heavy metal boxes, electrical boxes, heavy metal sheets, I-beams, H-beams, or the like. In the illustrated embodiment of the present disclosure, the object 102 is a heavy metal box, such as an electrical box to be fitted inside a panel or a case (not shown) which may be further positioned inside a turbomachine package assembly (not shown). The object 102 may include a flange 104, to which the lifting tool 100 may be clamped. The lifting tool 100 is further described in the following description provided in conjunction to FIG. 2 through FIG. 6.

Figure 2:
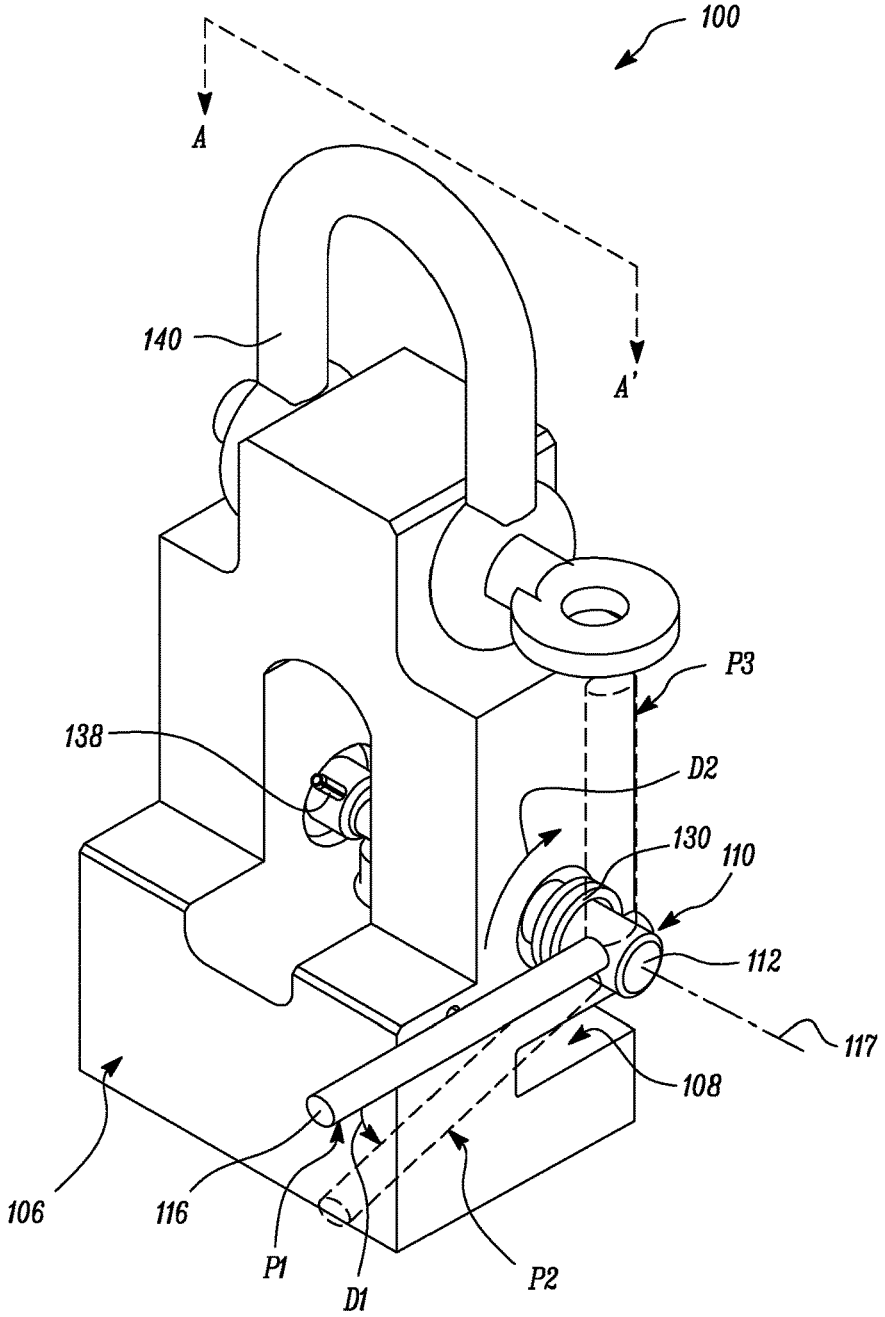
FIG. 2 illustrates a perspective view of an exemplary lifting tool, in accordance with the concepts of the present disclosure.
Figure 3:
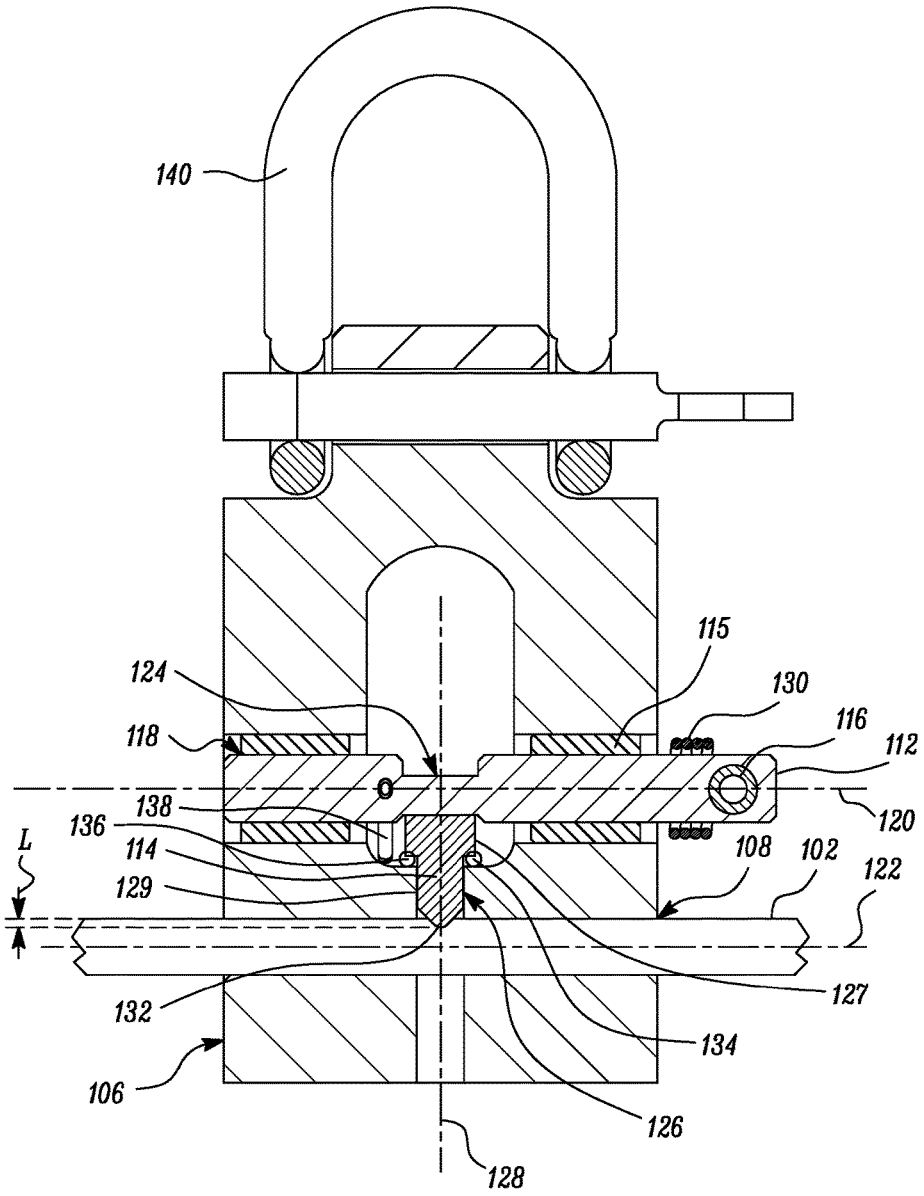
FIG. 3 illustrates a sectional view of the lifting tool, in accordance with the concepts of the present disclosure.

FIG. 2 illustrates a perspective view of the lifting tool 100, according to an embodiment of the present disclosure. FIG. 3 illustrates a sectional view of the lifting tool 100 taken across section A-A'. Referring to FIGS. 2 and 3, the lifting tool 100 includes a body 106 defining a gripping cavity 108 for receiving the object 102. The body 106 may be made up of aluminum or any other suitable material, such as steel, metal alloys, plastic, or the like.

The lifting tool 100 may be clamped to the flange 104 of the object 102, such that at least a portion of the flange 104 is received inside the gripping cavity 108. It may be contemplated that if the object 102 is a heavy metal plate, or an I bar, etc., the lifting tool 100 may be clamped to a suitable portion of the object 102 accordingly, without deviating from the scope of the claimed subject matter.

The lifting tool 100 further includes a locking arrangement 110 configured to lock the object 102 within the gripping cavity 108. In an embodiment of the present disclosure, the locking arrangement 110 includes a shaft 112, a pin 114 and an actuating member 116 coupled to the shaft 112.

The shaft 112 may be supported by one or more bushings 115 and is configured to rotate about its longitudinal axis 117. In an example, the body 106 of the lifting tool 100 may define a second cavity 118 configured to receive the shaft 112, such that a longitudinal axis 120 of the second cavity 118 is parallel to a longitudinal axis 122 of the gripping cavity 108.

In an embodiment of the present disclosure, the shaft 112 further includes an eccentric structure 124 configured to rotate along with the shaft 112 about the longitudinal axis 117. As illustrated, the eccentric structure 124 may be formed at a center portion of the shaft 112. Alternatively, the eccentric structure 124 may be a cam lobe coupled to and configured to rotate along with the shaft 112. In a yet another example, the shaft 112 may be formed of two components such that the eccentric structure 124 may be welded between the two components.

Further, the pin 114 is configured to engage with the eccentric structure 124 and move in and out of the gripping cavity 108 in response to the rotation of the eccentric structure 124. In an example, the body 106 may define a third cavity 126 configured to receive the pin 114, such that a longitudinal axis 128 of the third cavity 126 is perpendicular to the longitudinal axis 122 of the gripping cavity 108. The pin 114 may be configured to engage and disengage with the object 102 to lock and unlock it inside the gripping cavity 108 respectively. According to an embodiment of the present disclosure, the pin 114 includes a head portion 127 and a pin body portion 129 configured to form a T-shaped profile. It may be contemplated that the shape of the profile of the pin 114 is merely exemplary and is not to be construed as limiting in any manner.

The locking arrangement 110 further includes the actuating member 116 coupled to the shaft 112 and configured to facilitate rotation of the shaft 112 about its longitudinal axis 117, and consequently facilitate movement of the pin 114 in and out of the gripping cavity 108. In an example, the actuating member 116 is a lever. Alternatively, the actuating member 116 may be a rotatable knob, a switch, or any other actuating mechanism known in the art.

The locking arrangement 110 further includes a biasing member 130 coupled to the actuating member 116 and the body 106. The biasing member 130 is configured to bias the pin 114 in a first position. In an embodiment of the present disclosure, in the first position, a portion 132 of the pin 114 extends inside the gripping cavity 108. For example, the biasing member 130 is configured to bias the actuating member 116 in a first actuator position P1, which causes the shaft 112 to be positioned such that the eccentric structure 124 engages with the pin 114 to push the portion 132 of the pin 114 inside the gripping cavity 108. Examples of the biasing member 130, may include, but not limited to, a resilient spring member, or the like.

In an embodiment of the present disclosure, the pin 114, in the first position, locks the object 102 inside the gripping cavity 108. For example, the portion 132, extending inside the gripping cavity 108, engages with the object 102 to exert a retention force on the object 102 and lock it inside the gripping cavity 108. Additionally, the pin 114, being biased in the first position, also prevents inserting the object 102 inside the gripping cavity 108.

In an embodiment, the pin 114 is configured to move to a second position in response to a movement of the actuating member 116 in a first direction D1, from the first actuator position P1 to a second actuator position P2, to decrease the retention force on the object 102 inside the gripping cavity 108. As illustrated in FIG. 2, the first direction D1 may be downwards with respect to the first actuator position P1 and the second actuator position P2 may form an angle with the first actuator position P1 of the actuating member 116. For example, when an external force is applied to move the actuating member 116 in the first direction D1, the pin 114 moves towards the second position such that a length L of the portion 132 of the pin 114 extending into the gripping cavity 108 decreases. In the second position, the pin 114 is fully retracted outside the gripping cavity 108, thereby unlocking the object 102 within the gripping cavity 108 for releasing the lifting tool 100. Alternatively, in the second position of the pin 114, no portion of the pin 114 extends inside the gripping cavity and hence the object 102 may be inserted inside the gripping cavity 108 without any hindrance.

Further, the pin 114 is configured to move towards a third position in response to a movement of the actuating member 116 in a second direction D2, from the first actuator position P1 to a third actuator position P3, to increase the retention force on the object 102 inside the gripping cavity 108. For example, when an external force is applied to move the actuating member 116 in the second direction D2, the pin 114 moves towards the third position such that the retention force exerted on the object 102 inside the gripping cavity 108 increases. In the third position, the pin 114 is pushed further inside the gripping cavity 108, thereby tightly locking the object 102 within the gripping cavity 108. When there is no object 102 placed within the gripping cavity 108, it may be understood that the length L of the portion 132 extending inside the gripping cavity 108 in the third position of the pin 114 is greater than the length L of the portion 132 in the second position of the pin 114.

Further, the locking arrangement 110 includes a pair of O-rings 134, 136 coupled to the pin 114, which facilitate upward and downward movement of the pin 114 in response to the rotation of the shaft 112 and the eccentric structure 124. The O-rings 134, 136 may have resilient properties to exert resilient force on the pin 114, as the pin 114 moves between the first position, the second position and the third position. For example, as the pin 114 moves downward to extend inside the gripping cavity 108, such as in the first and the third position, the O-rings 134, 136 compress to retain the pin 114. Similarly, in the second position, the eccentric structure 124 disengages with the pin 114 and the O-rings 134, 136 retract to their respective original shape to support and pull the pin 114 upwards and outside the gripping cavity 108. The pair of O-rings 134, 136 are configured to keep the pin 114 intact inside the third cavity 126 during operation. Examples of O-rings 134, 136 include rubber O-rings, elastic material O-rings, or the like.

Furthermore, the locking arrangement 110 includes a stopper member 138 configured to limit the rotation of the shaft 112 corresponding to the second position and the third position of the pin 114. For example, the stopper member 138 may be a rod like structure positioned inside a cavity provided in the shaft 112. The stopper member 138 may be configured to rotate along with the shaft 112, and engage with the head portion of the pin 114 to restrict the movement of the shaft 112 beyond the corresponding second and the third position of the pin 114.

Furthermore, the lifting tool 100 includes a cable attachment structure 140 configured to receive a cable or a string for lifting the object 102. The cable attachment structure 140 may be a clevis mount, or ring type structure, or a hook type structure, or the like. As illustrated, the cable attachment structure 140 may be provided longitudinally spaced apart from the gripping cavity 108. However, it may be contemplated that the illustrated positioning and shape of the cable attachment structure 140 is merely exemplary and may be varied to achieve similar results without deviating from the scope of the claimed subject matter.

INDUSTRIAL APPLICABILITY

The present disclosure relates to a quick release lifting tool 100 that may be clamped to a heavy object 102 to facilitate lifting of the object 102. As explained previously, the object 102 may be a heavy sheet metal, metal panels, or metal boxes that are extremely heavy to be carried manually. For such heavy objects, one or more lifting tools 100 may be clamped to various portions of the object 102 to facilitate attachment of a cable for lifting the object 102 by means of a loading or unloading machine, such as a crane. The lifting tool 100 may be clamped proximal to the corners of the object 102 to evenly distribute the load of the object 102 while lifting. However, it may be contemplated that the positioning of the lifting tools 100 may be adjusted according to the desired load distribution of the object 102 while lifting. For example, if the object 102 is a metal box that heavier on one side, then in order to balance the object 102 while lifting, the lifting tools 100 may be positioned accordingly.

Figure 4B:
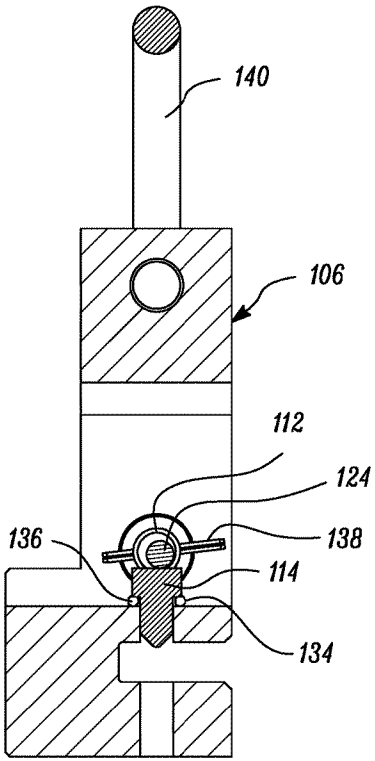
FIGS. 4A and 4B illustrate the lifting tool with a pin in first position, in accordance with an embodiment of the present disclosure.
Figure 4A:
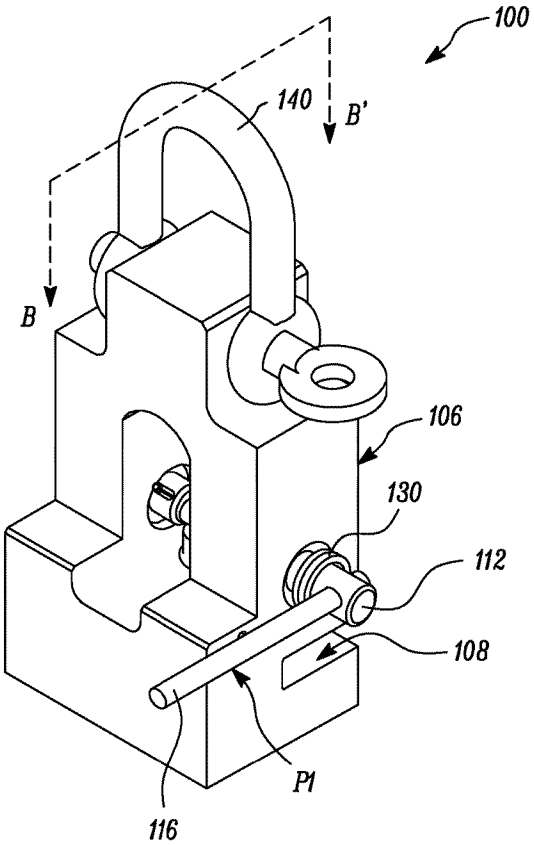

FIGS. 4 to 6 illustrate the operation of the lifting tool 100 for locking and unlocking the object 102 inside the gripping cavity 108. In an embodiment of the present disclosure, the biasing member 130 biases the actuating member 116 in the first actuator position P1, (as shown in FIG. 4A) which consequently biases the pin 114 in the first position. In the first position, the portion 132 of the pin 114 extends inside the gripping cavity 108, as shown in FIG. 4B. In the first position of the pin 114, the stopper member 138 does not engage with the pin 114, thereby allowing further rotation of the shaft 112 to move the pin 114.

Figure 5B:
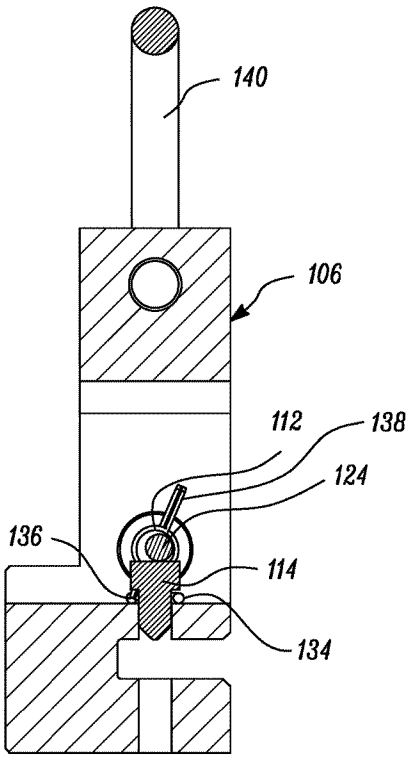
FIGS. 5A and 5B illustrate the lifting tool with the pin in a second position, in accordance with the embodiment of the present disclosure.
Figure 5A:
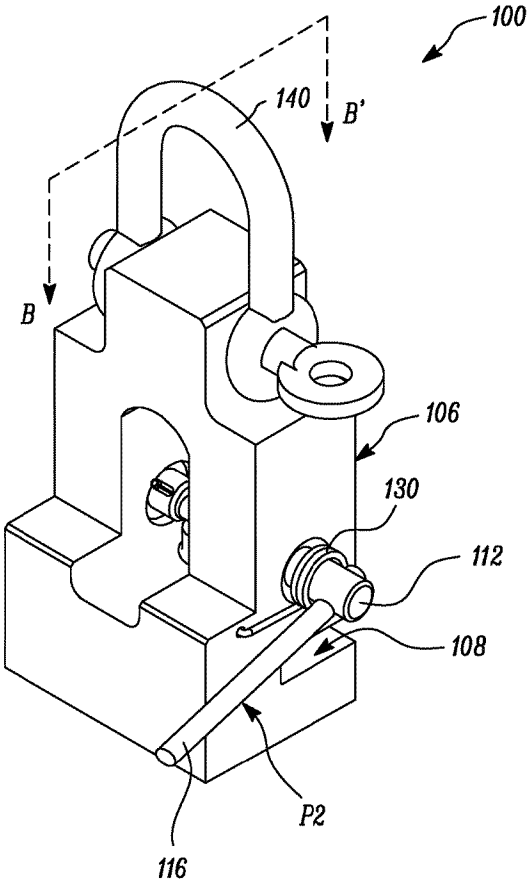

Further, as shown in FIGS. 5A and 5B, the actuating member 116 may be pressed downwards, to retract the pin 114 outside the gripping cavity 108 and subsequently position the object 102 inside the gripping cavity 108. For example, an operator positioning the lifting tool 100 on the object 102, may exert a force to move the actuating member 116 in the first direction D1 and subsequently position the object 102 inside the gripping cavity 108. As the actuating member 116 moves in the direction D1, the stopper member 138 also rotates and abuts the head portion 127 of the pin 114 (as shown in FIG. 5B) to restrict further rotation of the shaft 112 and consequently the actuating member 116.

As soon as the operator removes the exerted force, the actuating member 116, being biased, moves back to the first actuator position P1. The portion 132 of the pin 114 engages with the object 102 and locks it inside the gripping cavity 108.

Figure 6B:
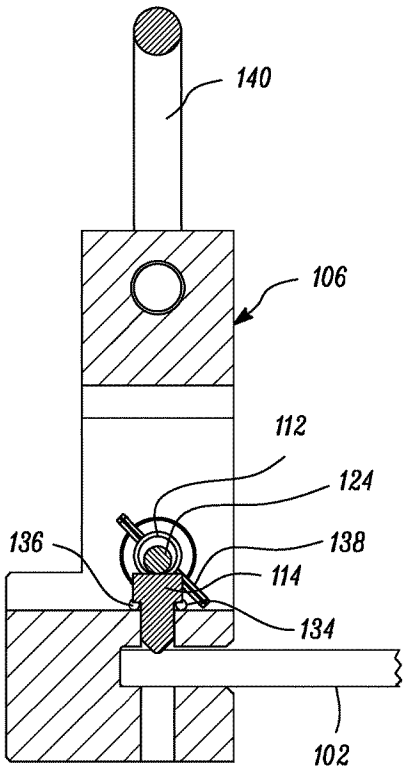
FIGS. 6A and 6B illustrate the lifting tool with the pin in a third position, in accordance with the embodiment of the present disclosure.
Figure 6A:
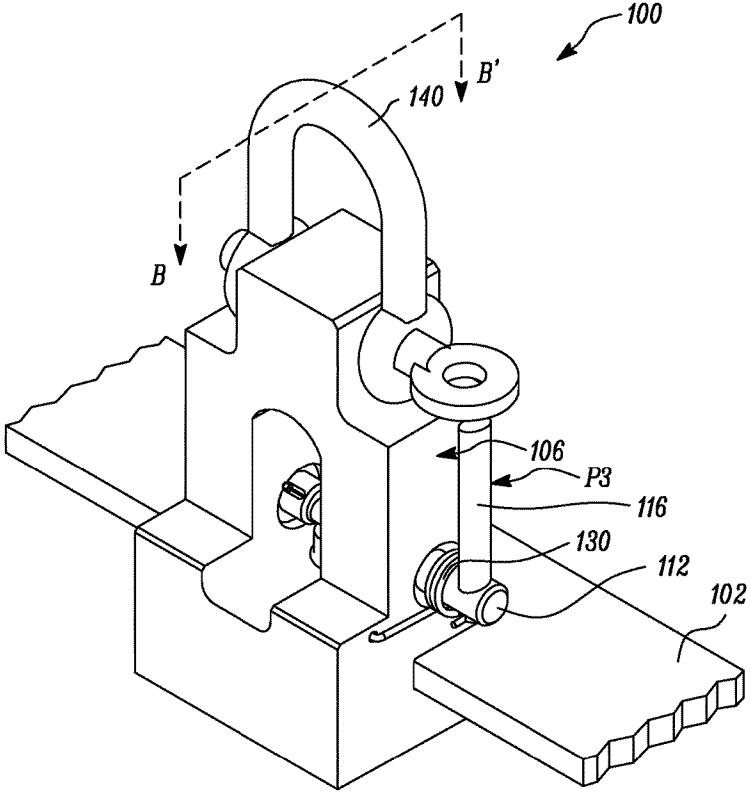

Furthermore, the operator may exert a force to move the actuating member 116 upwards, in direction D2, from the first actuator position P1 to the third actuator position P3 (as shown in FIG. 6A) to increase the retention force on the object 102 locked within the gripping cavity 108. As the actuating member 116 moves in the direction D2, the stopper member 138 also rotates and abuts the head portion 127 of the pin 114 (as shown in FIG. 6B) to restrict further rotation of the shaft 112 and consequently the actuating member 116.

The lifting tool 100 according to the various embodiments of the present disclosure, provides easy and safe clamping to the object 102. The actuating member 116 is biased to the first actuator position P1 which locks the object 102 inside the gripping cavity 108. The actuating member 116 is substantially perpendicular to the body 106 of the lifting tool 100 when in the first actuating position P1. Therefore, when the object 102 is positioned inside a case or a panel, the operator may slightly with a push of a finger, lower the actuating member 116 to disengage the lifting tool 100 from the object 102. Additionally, when the actuating member 116 accidentally interferes with the panel or case edges, the actuating member 116 may only be moved upwards, or in the direction D2, thereby tightly locking the lifting tool 100 to the object 102, instead of loosening it or disengaging it from the object 102.

While aspects of the present disclosure have been particularly shown, and described with reference to the embodiments above, it will be understood by those skilled in the art that various additional embodiments may be contemplated by the modification of the disclosed machines, systems, and methods without departing from the spirit and scope of what is disclosed. Such embodiments should be understood to fall within the scope of the present disclosure as determined based upon the claims and any equivalents thereof.

What is claimed is:

1. A lifting tool for gripping an object, the lifting tool comprising:
- a body defining a gripping cavity for receiving the object; and
- a locking arrangement for locking the object within the gripping cavity, the locking arrangement including:
  - a shaft having an eccentric structure and configured to rotate about a longitudinal axis; and
  - a pin configured to engage with the eccentric structure and lock the object within the gripping cavity, the pin being biased in a first position;
  - wherein in the first position, a portion of the pin extends into the gripping cavity and is configured to lock the object within the gripping cavity; and
  - wherein the body defines a second cavity configured to receive the shaft, the second cavity having a longitudinal axis parallel to a longitudinal axis of the gripping cavity.

2. The lifting tool as claimed in claim 1, wherein the locking arrangement further comprising an actuating member coupled to the shaft and configured to move the pin between a second position and a third position.

3. The lifting tool as claimed in claim 2, wherein the pin is configured to move towards the second position in response to a movement of the actuating member in a first direction, to decrease a retention force on the object.

4. The lifting tool as claimed in claim 3, wherein the pin is configured to move towards the third position in response to a movement of the actuating member in a second direction, to increase the retention force on the object.

5. The lifting tool as claimed in claim 4, wherein
- a length of the portion of the pin extending into the gripping cavity decreases as the pin moves towards the second position; and
- the length of the portion of the pin extending into the gripping cavity increases as the pin moves towards the third position.

6. The lifting tool as claimed in claim 4, wherein the locking arrangement further comprising a stopper member engaged with the shaft and configured to restrict the rotation of the shaft corresponding to the second position and the third position of the pin.

7. The lifting tool as claimed in claim 2 wherein the locking arrangement further comprising a biasing member coupled to the actuating member and configured to bias the pin in the first position.

8. The lifting tool as claimed in claim 1, wherein the locking arrangement further comprising a pair of O-rings coupled to the pin.

9. The lifting tool as claimed in claim 1, wherein the body defines a third cavity configured to receive the pin, the third cavity having a longitudinal axis perpendicular to a longitudinal axis of the gripping cavity.

10. The lifting tool as claimed in claim 1 further comprising a cable attachment structure configured to receive a cable for lifting the object.

11. A lifting tool for gripping an object, the lifting tool comprising:

a body defining a gripping cavity for receiving the object; and a locking arrangement for locking the object within the gripping cavity, the locking arrangement including:

a shaft having an eccentric structure and configured to rotate about a longitudinal axis;

a pin configured to engage with the eccentric structure and lock the object within the gripping cavity, the pin being biased in a first position and configured to move between a second position and a third position, wherein in the first position, a portion of the pin extends into the gripping cavity and is configured to lock the object within the gripping cavity; and an actuating member coupled to the shaft and configured to move the pin; and wherein the pin being configured to move towards the second position in response to a movement of the actuating member in a first direction to decrease a retention force on the object, and move towards the third position in response to the movement of the actuating member in a second direction to increase the retention force on the object.

12. The lifting tool as claimed in claim 11, wherein a length of the portion of the pin extending into the gripping cavity decreases as the pin moves towards the second position.

13. The lifting tool as claimed in claim 12, wherein the length of the portion of the pin extending into the gripping cavity increases as the pin moves towards the third position.

14. The lifting tool as claimed in claim 11, wherein the locking arrangement further comprising a stopper member engaged with the shaft and configured to restrict the rotation of the shaft corresponding to the second position and the third position of the pin.

15. The lifting tool as claimed in claim 11, wherein the locking arrangement further comprising a biasing member coupled to the actuating member and configured to bias the pin in the first position.

16. The lifting tool as claimed in claim 11, wherein the locking arrangement further comprising a pair of O-rings coupled to the pin.

17. The lifting tool as claimed in claim 11, wherein the body defines a second cavity configured to receive the shaft, the second cavity having a longitudinal axis parallel to a longitudinal axis of the gripping cavity.

18. The lifting tool as claimed in claim 17, wherein the body defines a third cavity configured to receive the pin, the third cavity having a longitudinal axis perpendicular to a longitudinal axis of the gripping cavity.

19. The lifting tool as claimed in claim 11 further comprising a cable attachment structure configured to receive a cable for lifting the object.

* * * * *